United States Patent [19]

Groth

[11] Patent Number: 4,674,377

[45] Date of Patent: Jun. 23, 1987

[54] APPARATUS FOR PERFORATING PAPER WEBS AND THE LIKE

[75] Inventor: Kurt Groth, Möhlin, Switzerland

[73] Assignee: GRAPHA-Holding AG, Hergiswil, Switzerland

[21] Appl. No.: 863,613

[22] Filed: May 15, 1986

[30] Foreign Application Priority Data

May 17, 1985 [CH] Switzerland ..... 02102/85

[51] Int. Cl.[4] ..... B26F 1/08

[52] U.S. Cl. ..... 83/324; 83/346; 83/347; 83/561

[58] Field of Search ..... 83/324, 346, 347, 561

[56] References Cited

U.S. PATENT DOCUMENTS 4,063,493 12/1977 McEvers et al. ..... 83/347 X

*Primary Examiner*—James M. Meister

*Attorney, Agent, or Firm*—Peter K. Kontler

[57] ABSTRACT

A perforating apparatus wherein two rolls define a nip for a running web of paper which is provided with rows of transverse perforations by tools at the periphery of one of the rolls. The rolls are driven in opposite directions by a timing shaft through the medium of a system of gears including an intermediate gear which indirectly drives the one roll and is directly or indirectly mounted on an eccentric. The eccentric is driven by a power train including a differential one output shaft of which carries the eccentric and another output shaft of which is normally held against rotation but can be turned by a worm to thereby change the phase of the one output shaft relative to the input shaft of the differential to thus compensate for eventual inaccuracies in the distribution of perforating tools at the periphery of the one roll. The input shaft of the differential is driven by a second system of gears, and the rolls are driven in such a way that they rotate through identical angles during each cycle of the apparatus.

12 Claims, 4 Drawing Figures

APPARATUS FOR PERFORATING PAPER WEBS AND THE LIKE

BACKGROUND OF THE INVENTION

The invention relates to apparatus for perforating running webs of paper, plastic foil or the like. More particularly, the invention relates to improvements in perforating apparatus of the type wherein the web which is to be provided with spaced-apart transversely extending perforations is caused to pass through the nip of two rolls one of which constitutes an anvil for one or more elongated perforating tools on the other roll.

Apparatus of the just outlined character are normally provided with a timing shaft which drives the two rolls in opposite directions by way of a gear train. Such apparatus can be used with advantage for the making of coherent forms or like sheets having predetermined sizes and being readily separable from each other along the rows of perforations. The web of paper which is to be converted into a series of coherent forms is caused to pass through an imprinting mechanism before it reaches the nip of the rolls, and the thus treated web is thereupon folded back and forth in zig-zag fashion to be converted into a pile of overlapping forms wherein each intermediate form is separably connected to a pair of neighboring forms. As a rule, the length of the peripheral surface (as measured in the circumferential direction) of the roll which carries the perforating tools exceeds the length of a single form, i.e., such roll carries two or more perforating tools so that it can provide the running web with two or more transversely extending rows of perforations in response to each revolution of its shaft.

A drawback of conventional perforating apparatus is that even minor deviations of mutual distances of neighboring tools from one another, or very small differences between the perforating tools, can result in the accumulation of highly unsatisfactory stacks. For example, if one of the rolls carries two perforating tools and the mutual spacing of the tools (considered in the circumferential direction of the respective roll) deviates from ideal spacing by 0.05 mm, a first form is 0.05 mm shorter than an ideal form, the second form is 0.05 mm longer than an ideal form, the third form is 0.05 mm shorter, and so forth. If the stack has 2000 coherent forms and the thickness of a form is 0.1 mm, the height of one side of the stack exceeds the height of the opposite side by 100 mm. Such stacks must be discarded because they are unsightly and cannot be readily packed and/or otherwise treated.

In accordance with a known proposal, the aforedescribed drawbacks of conventional perforating apparatus are eliminated by starting the apparatus to form a stack, measuring the stack and providing the roll for the perforating tools with shims whose dimensions are selected with a view to ensure the formation of more satisfactory stacks if the dimensions of the measured (first) stack deviate from optimum dimensions. This is a time-consuming operation, especially since the same procedure must be repeated whenever the apparatus is to be set up for the making of longer or shorter forms.

In accordance with another known proposal, the means for rotating the roll for the perforating tools includes a gear which is mounted on an adjustable eccentric. This renders it possible to impart to the corresponding roll a slightly irregular rotary movement. The phase of such irregular movement can be changed only when the gear is at a standstill; therefore, an accurate adjustment is possible only by continuing the trial and error procedure as long as necessary. This is also a time-consuming operation which is particularly undesirable when one and the same apparatus is to be used to make shorter or longer forms.

OBJECTS AND SUMMARY OF THE INVENTION

An object of the invention is to provide a perforating apparatus wherein the spacing between successive transverse perforations which are applied to a running web of paper or the like can be altered while the apparatus is in use.

Another object of the invention is to provide an apparatus wherein the defects in mutual spacing of perforations can be cured rapidly so that the number of unsatisfactory products (such as forms) can be reduced to a minimum.

A further object of the invention is to provide novel and improved means for counteracting the effects of improper distribution of perforating tools on the roller for such tools.

An additional object of the invention is to provide novel and improved means for effectively eliminating or lessening the effects of selection of less than optimal tools on the rotary tool carrier.

The improved apparatus is used to treat running webs of paper, plastic foil or the like and comprises a first and a second preferably cylindrical roll. The rolls define a nip and one of the rolls has a plurality of circumferentially spaced-apart perforating tools which serve to perforate the web which passes through the nip while the rolls rotate about their respective axes. The apparatus further comprises a timing shaft or another suitable rotary torque transmitting member, first drive means for rotating the rolls in opposite directions including a gear train which is interposed between the torque transmitting member and the one roll and has an intermediate gear, a rotary eccentric for the intermediate gear, second drive means for rotating the eccentric including a differential with an input element which is driven by the torque transmitting member and a rotary output element which carries the eccentric and is driven by the input element, and means for changing the angular position of the output element and of the eccentric independently of the input element.

The apparatus can further comprise an auxiliary torque transmitting device which includes cooperating first and second Schmitz rings respectively provided on the first and second rolls. The ratio of diameters of the Schmitz rings is preferably selected in such a way that the other roll tends to brake the one roll.

In accordance with one embodiment of the invention, the intermediate bear of the gear train which forms part of the first drive means is mounted directly on the eccentric. Alternatively, the apparatus can comprise means for oscillating the intermediate gear about the axis of one of the rolls, e.g., about the axis of the roll which carries the perforating tools. Such oscillating means can comprise a first link which is rotatably mounted on the eccentric and a second link which is articulately connected with the first link at a location remote from the eccentric and is pivotable (not unlike a pendulum) about the axis of the selected roll. The intermediate gear is rotatably mounted in the second link intermediate the axis of the selected roll and the locus where the links are coupled to each other.

The gear train of the first drive means can further comprise a second gear which is coaxial with and is driven by the torque transmitting member and mates with the intermediate gear, and a third gear which is coaxial with and drives the one roll and mates with the intermediate gear. The drive means which includes the just described gear train further comprises a fourth gear which is coaxial with and is drivingly connected to the other roll and mates with the second gear.

The means for changing the angular position of the output element of the differential can comprise a second rotary output element which forms part of the differential and serves to rotate the first named output element, and means for rotating the second output element. The output elements are preferably coaxial with one another and with the input element of the differential, and the means for rotating the second output element can comprise a worm wheel on the second output element and a worm which mates with the worm wheel and can be rotated by hand or by a motor. The apparatus can further comprise means for indirectly indicating the selected angular position of the second output element (i.e., the extent and direction of angular displacement of the first named output element relative to the input element independently of the input element).

The second drive means can further comprise a second gear train which is interposed between the torque transmitting member and the input element of the differential.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
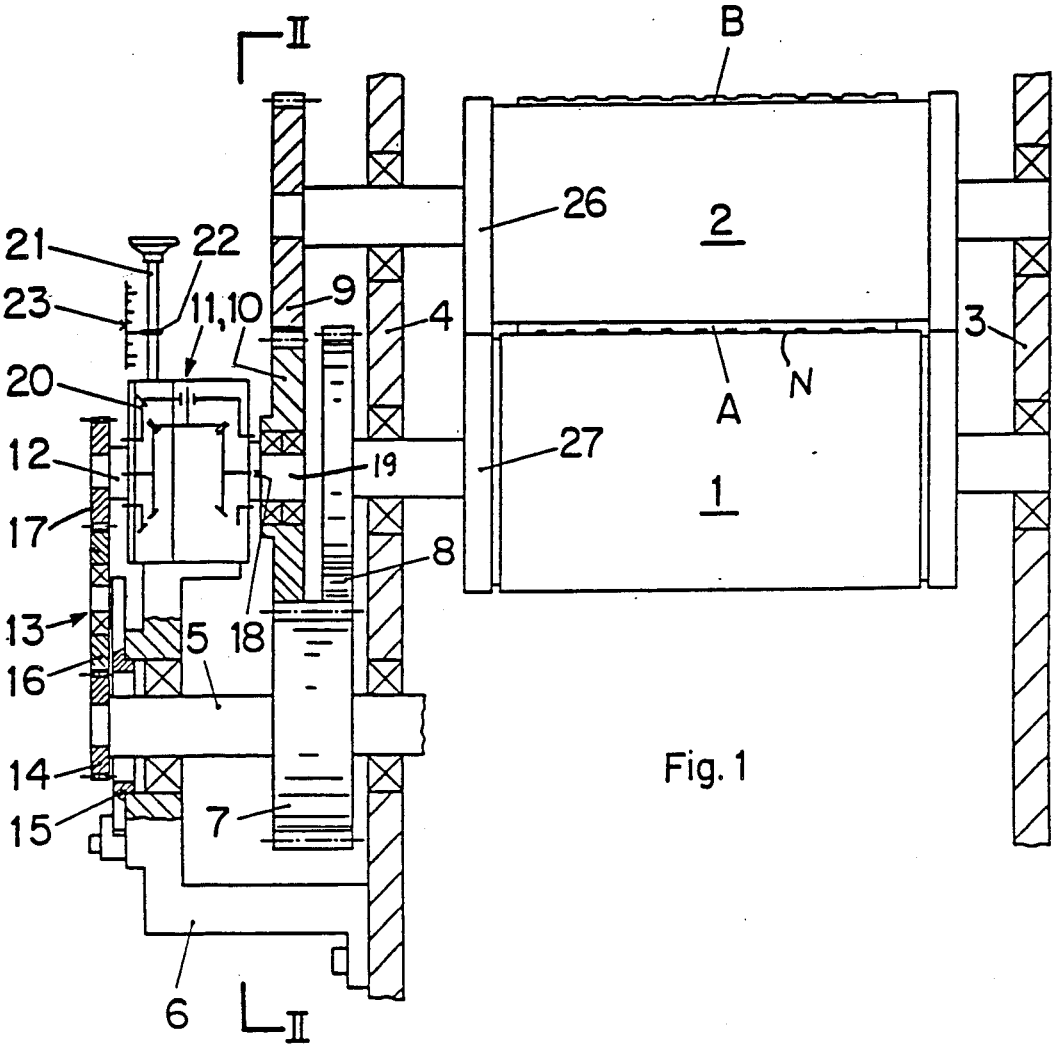
FIG. 1 is a schematic vertical sectional view of a perforating apparatus which embodies one form of the invention.

FIG. 1 shows a perforating apparatus having cylindrical rolls 1 and 2 which define a nip N. The shafts of the rolls 1 and 2 are rotatable about parallel axes and their end portions are journalled in stationary frame members or cheeks 3, 4. The apparatus further comprises a torque transmitting timing shaft 5 which is rotatable in the frame member 4 and is driven by a prime mover, not shown. The timing shaft 5 is further journalled in a bracket 6 which is affixed (e.g., bolted) to the frame member 4. That portion of the timing shaft 5 which is disposed between the frame member 4 and the bracket 6 carries a gear 7 which forms part of a first drive means (7–10) and meshes with two additional gears 8 and 10. The gear 8 is coaxially secured to the shaft of the roll 1, and the gear 10 is an intermediate gear which is mounted on a rotary output element 18 in the casing of a bevel gear differential 11 and meshes with a further gear 9 on the shaft of the roll 2. The gears 7, 9, 10 constitute a gear train of the first drive means.

The differential 11 is mounted on the bracket 6 and includes a rotary input element 12 which is driven by the timing shaft 5 by way of a gear train 13. The gear train 13 comprises a gear 14 which is affixed to the timing shaft 5, a gear 17 which is interchangeably affixed to the input element 12, and an intermediate gear 16 mounted on an arm 15 which is rotatable on the timing shaft 5. The output element 18 of the differential 11 has an eccentric portion 19 for the intermediate gear 10. A second output element 20 of the differential 11 is mounted in the casing of the differential 11 and is provided with a worm wheel in mesh with a worm 21 which is rotatably journalled in the casing of the differential 11. The worm 21 blocks the worm wheel, i.e., the output element 20 can be rotated only in response to intentional rotation of a knob at the accessible (exposed) outer end of the worm 21. It is clear that the apparatus can be provided with a servomotor (not shown) to rotate the worm 21 in lieu of rotating the worm by hand.

By rotating the worm 21, the person in charge can change the angular position (phase) of the output element 18 relative to the input element 12 of the differential 11. The parts 11–18 together constitute a (second) drive means which drivingly connects the timing shaft 5 with the eccentric portion 19.

The worm 21 carries a pointer or index 22 movable along a suitably graduated scale 23 to allow for rapid determination of angular positions of the elements 12 and 18 relative to each other.

The illustrated differential 11 is a commercially available unit, for example, of the type sold by Zahnrad- und Getriebefabrik Siegfried F. Tandler, D-2800 Bremen, German Federal Republic.

Figure 2:
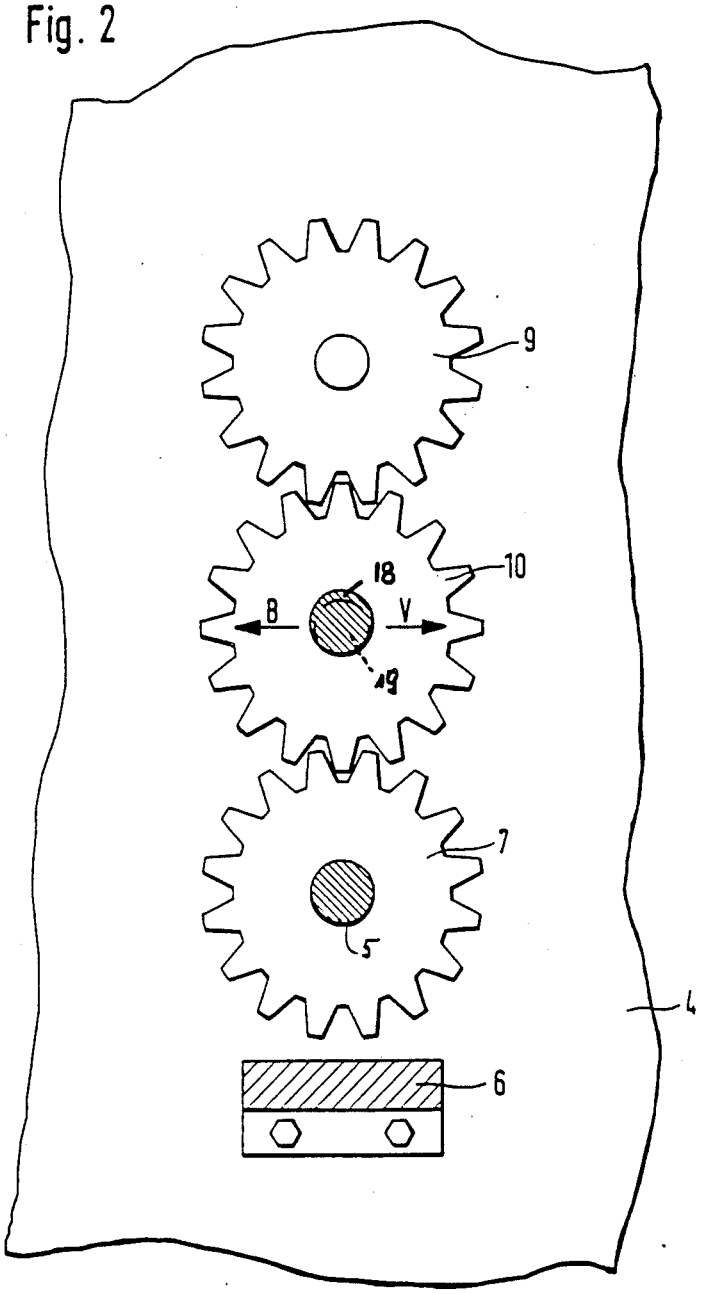
FIG. 2 is a fragmentary sectional view as seen in the direction of arrows from the line II—II of FIG. 1.

The perforating roll 2 which is shown in FIG. 1 is provided with perforating tools A and B which are disposed diametrically opposite each other. However, it is equally within the purview of the invention to provide the roll 2 with three or more equidistant perforating tools. The removable gear 17 is then replaced with a gear having a different pitch. The pitch is selected in such a way that the input element 12 of the differential 11 completes n/2 revolutions during one revolution of the roll 2 (n is the pitch of the roll 2 (i.e., the number of tools on the roll 2). In the embodiment of FIGS. 1 and 2, the input element 12 completes one revolution for each revolution of the roll 2.

Figure 4:
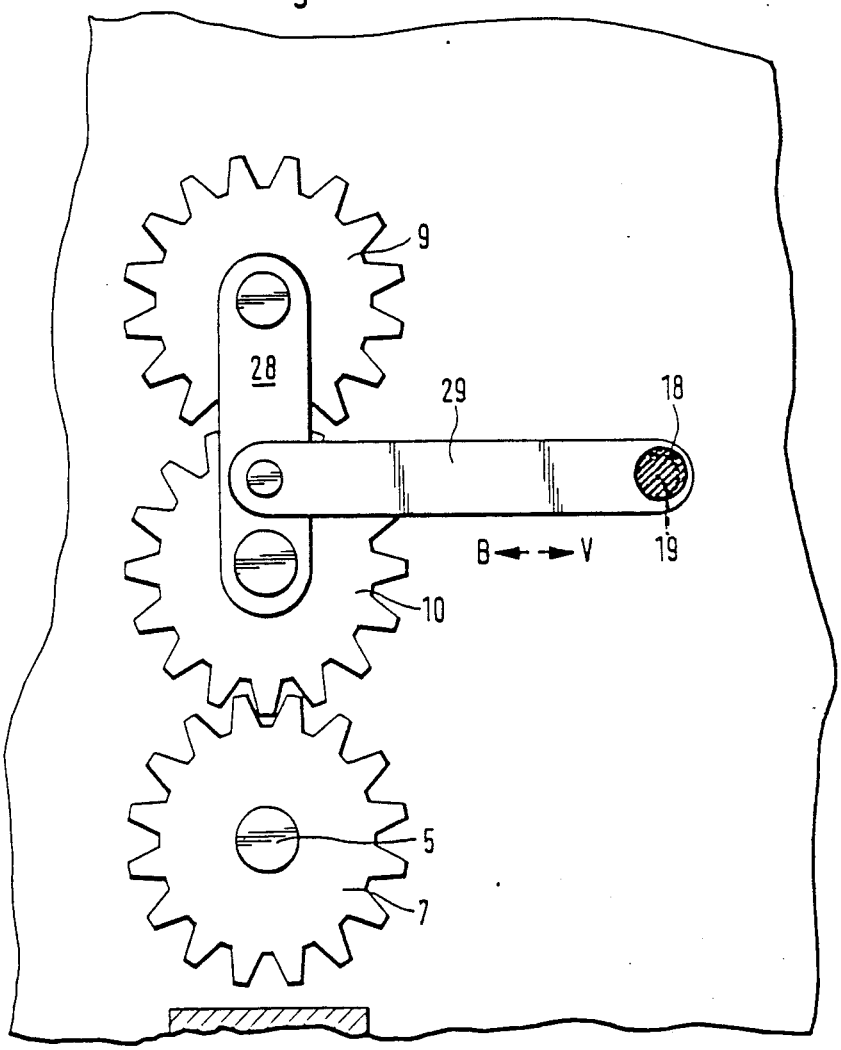
FIG. 4 is a view similar to that of FIG. 2 but showing a portion of a modified apparatus.

When the perforating apparatus is in use, i.e., when the prime mover drives the timing shaft 5, the eccentrically mounted intermediate gear 10 performs an up- and down-movement as well as a back-and-forth movement (indicated in FIG. 4 by the arrows B and V). The up- and down-movement does not influence the peripheral speed of the roll 2 because such movement does not alter the transmission ratio of the gear train including the intermediate gear 10. However, the back- and forth movements of the intermediate gear 10 entail a deceleration of the gear 9 (arrow V) or an acceleration of such gear (arrow B) and hence of the shaft of the roll 2. Thus, the mounting of the intermediate gear 10 on the eccentric portion 19 of the output element 18 entails a sinusoidal acceleration and deceleration of the gear 9 and roll 2.

If the intermediate gear 10 were not eccentrically mounted and the mutual spacing of the tools A and B (note the distances $1_1$ and $1_2$ in the diagram of FIG. 3) were identical (as measured in the circumferential direction of the roll 2), the tool A would extend radially of the peripheral surface of the roll 1 in the starting or zero (0°) position of the timing shaft 5. During rotation of the roll 2, the distance covered by the tool A would increase linearly with increasing angular displacement of the timing shaft 5 (note the straight-line curve 24 of FIG. 3). This would move the other tool B to a position radially of the roll 1 in response to an angular displacement of the timing shaft 5 through 180°, and the tool A would reassume its original position (radially of the peripheral surface of the roll 1) upon an additional angular displacement of the timing shaft 5 through 180°. The sinusoidal curve 25 denotes in FIG. 3 the distances covered by the tools A and B during each revolution of the timing shaft 5 due to mounting of the intermediate gear 10 on the eccentric portion 19 of the output element 18 of the differential 11. The roll 2 is accelerated and decelerated at a predetermined rate due to movements of the intermediate gear 10 in the directions which are indicated by the arrows B and V. Thus, the angular displacement of the roll 2 is not constant; instead, it follows the curve 25.

Figure 3:
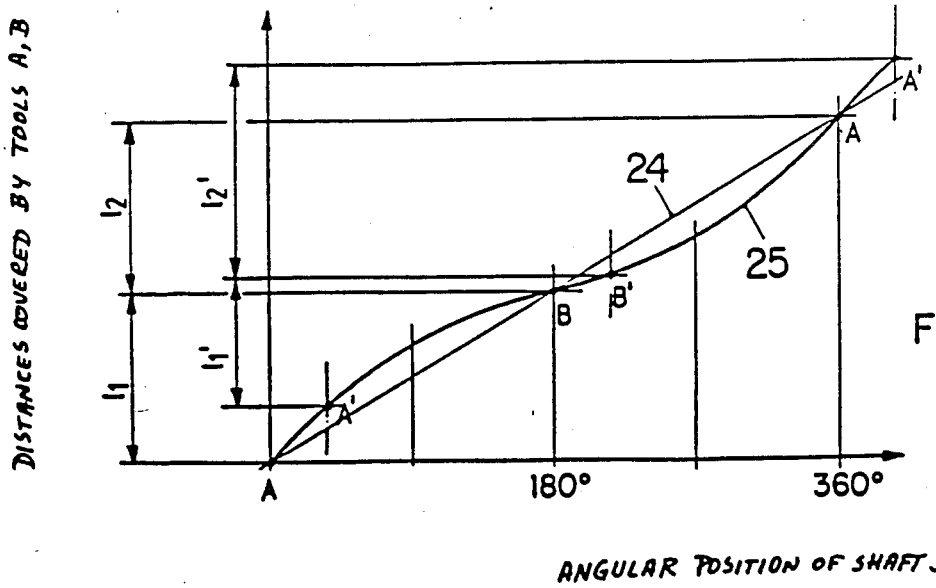
FIG. 3 is a diagram showing the manner in which the angular displacement of the second output element of the differential influences the distances covered by the perforating tools in response to angular displacement of the timing shaft.

If the operator decides to rotate the worm 21, i.e., to change the phase of the output element 18 of the differential 11 relative to the input element 12, this entails a change of the phase of the roll 2 relative to the timing shaft 5. Thus, when the timing shaft 5 assumes its zero position, the tool A does not extend radially of the peripheral surface of the roll 1; the tool A reaches such angular position only after the timing shaft 5 completes a certain angular movement (note the position A′ in FIG. 3). Analogously, the exact distance covered by the roll 2 to move the tool B to a position exactly radially of the peripheral surface of the roll 1 is also changed (note the position B′ in FIG. 3). The diagram of FIG. 3 shows that the sum of $1_1$, and $1_2'$ is constant (it equals the sum of $1_1$ and $1_2$) but the distance which a point at the periphery of the roll 2 must cover to advance the tools A and B to positions exactly radially of the peripheral surface of the roll 1 is changed. The operator can infinitely vary the ratio of $1_1$, $1_2'$ by the simple expedient of turning the worm 21 to thereby change the angular position of the worm wheel 20. Thus, the operator can compensate for eventual deviations of actual positions of the tools A and B relative to each other from those positions in which the two tools are disposed exactly diametrically opposite one another. The adjustments can be carried out while the perforating apparatus is in actual use.

The distance covered by any selected point on the roll 1 matches the distance covered by any selected point on the roll 2 during each cycle of the apparatus.

Any play which would tend to develop between the teeth of the mating gears 7, 9 and 10 as a result of eccentric mounting of the intermediate gear 10 on the output element 18 can be readily compensated for in any conventional way, e.g., by backlash compensating gears which are adjusted automatically so that the transmission of torque between the gears 7, 9 and 10 takes place without any interruptions. Elimination of backlash is a technique which is well known in the art of gear transmissions.

The just discussed play eliminating means can be utilized in addition to or in lieu of an auxiliary torque transmitting device including Schmitz rings 26, 27 (also called bearer rings or cylinder bearers) which are provided on the rolls 1 and 2, respectively. These rings effectively prevent any angular play between the rolls 1, 2 when the perforating apparatus is in use. The diameters of the Schmitz rings 26 and 27 are preferably selected in such a way that the rings tend to apply to the roll 2 a slight braking force. Experiments with the improved apparatus confirm that the Schmitz rings 26 and 27 ensure the elimination of any play without undergoing excessive wear and/or rapid overheating in actual use.

FIG. 4 shows a portion of a modified perforating apparatus wherein the shaft of the intermediate gear 10 is mounted in the median portion of a link 28 which is pivotable about the axis of the gear 9 and is oscillated by a second link 29. The link 29 is mounted on the eccentric portion 19 of the output element 18. In all other respects, the construction of the apparatus embodying the structure of FIG. 4 is or can be identical with that of the apparatus which is shown in FIGS. 1 and 2. The mode of operation of the second apparatus is analogous to that of the apparatus of FIGS. 1 and 2. The movements in the directions of arrows B and V influence the angular velocity of the roll 2 in the aforedescribed manner, and the phase of the output element 18 relative to the timing shaft 5 can be changed through the medium of the worm 21 (not shown in FIG. 4) either by hand or by a servomotor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for treating a running web of paper or the like, comprising a first and a second roll, said rolls defining a nip and one thereof having a plurality of circumferentially spaced-apart perforating tools arranged to perforate the web which passes through said nip while said one roll rotates about its axis; a rotary torque transmitting member; first drive means for rotating said rolls in opposite directions, including a gear train interposed between said member and said one roll and having an intermediate gear; a rotary eccentric for said intermediate gear; second drive means for rotating said eccentric including a differential having an input element driven by said member and a rotary output element carrying said eccentric and driven by said input element; and means for changing the angular position of said output element independently of said input element.

2. The apparatus of claim 1, further comprising an auxiliary torque transmitting device including cooperating first and second Schmitz rings respectively provided on said first and second rolls.

3. The apparatus of claim 2, wherein the ratio of the diameters of said rings is such that the other of said rolls tends to brake said one roll.

4. The apparatus of claim 1, wherein said intermediate gear is mounted directly on said eccentric.

5. The apparatus of claim 1, further comprising means for oscillating said intermediate gear about the axis of said first roll in response to rotation of said output element.

6. The apparatus of claim 5, wherein said oscillating means comprises a first link rotatably mounted on said eccentric and a second link coupled to said first link and pivotable about the axis of said first roll, said intermediate gear being rotatably mounted in said second link.

7. The apparatus of claim 1, wherein said gear train further comprises a second gear coaxial with and driven by said member and mating with said intermediate gear, and a third gear drivingly connected with said one roll and mating with said intermediate gear, said first drive means further comprising a fourth gear drivingly connected with the other of said rolls and mating with said second gear.

8. The apparatus of claim 1, wherein said means for changing the angular position of said output element comprises a second rotary output element provided in said differential and arranged to rotate said first named output element, and means for rotating said second output element.

9. The apparatus of claim 8, wherein said output elements are coaxial with said input element and the means for rotating said second output element comprises a worm wheel on said second output element and a worm mating with said worm wheel.

10. The apparatus of claim 9, wherein said worm is rotatable by hand and further comprising means for indicating the selected position of said second output element.

11. The apparatus of claim 1, wherein said second drive means comprises a second gear train interposed between said member and said input element.

12. The apparatus of claim 1, wherein said torque transmitting member includes a timing shaft which is parallel with said rolls.

* * * * *